US009289040B2

(12) United States Patent
Appleton

(10) Patent No.: US 9,289,040 B2
(45) Date of Patent: Mar. 22, 2016

(54) MULTIPLE EXTERIOR REVERSIBLE TOTE-BAG

(76) Inventor: Lovette Appleton, Cliffside Park, NJ (US)

( * ) Notice: Subject to any disclaimer, the term of this patent is extended or adjusted under 35 U.S.C. 154(b) by 0 days.

(21) Appl. No.: 13/385,180

(22) Filed: Feb. 6, 2012

(65) Prior Publication Data

US 2012/0273100 A1 Nov. 1, 2012

Related U.S. Application Data

(60) Provisional application No. 61/439,846, filed on Feb. 5, 2011.

(51) Int. Cl.
*A45C 3/06* (2006.01)
*A45C 7/00* (2006.01)

(52) U.S. Cl.
CPC . *A45C 3/06* (2013.01); *A45C 7/009* (2013.01); *A45C 7/0086* (2013.01)

(58) Field of Classification Search
CPC ..... A45C 3/06; A45C 13/08; A45C 3/08; A45C 13/02; A45C 1/024
USPC ..... 150/100, 103, 104, 105, 112, 118; 190/100, 103, 110, 111, 112; 224/153, 224/581, 657; 383/2, 41, 6; D3/233, 304
See application file for complete search history.

(56) References Cited

U.S. PATENT DOCUMENTS

| | | | | |
|---|---|---|---|---|
| 5,501,338 | A * | 3/1996 | Preston | A45C 11/20 206/499 |
| 6,050,726 | A * | 4/2000 | Hoerl | E01H 1/1206 294/1.3 |
| 6,257,473 | B1 * | 7/2001 | Ringelstetter | E01H 1/1206 119/795 |
| 6,460,925 | B1 * | 10/2002 | Kovacs | A47C 7/62 190/102 |
| 2005/0111763 | A1 * | 5/2005 | Jung | E01H 1/1206 383/22 |
| 2010/0224294 | A1 * | 9/2010 | Svenson | A45C 3/001 150/103 |

* cited by examiner

*Primary Examiner* — Fenn Mathew
*Assistant Examiner* — Cynthia Collado
(74) *Attorney, Agent, or Firm* — Stephen Cannavale, Esq.

(57) ABSTRACT

A reversible tote bag comprising: a selectively openable and closable bag opening; a plurality of compartments, each having an interior storage area; a first exterior bag surface and a second exterior bag surface; wherein the first or the second exterior surface of each of the plurality of compartments may be selectively displayed by turning the tote bag inside out; s device for selectively opening and closing the tote bag opening; and, at least one device for toting the tote bag, wherein the plurality of compartments are attached to each other along a single line such that each compartment moves independently along the single top seam while attached to each other.

11 Claims, 3 Drawing Sheets

MULTIPLE EXTERIOR REVERSIBLE TOTE-BAG

This Application claims priority from U.S. Provisional Application Ser. No. 61/439,846 filed on Feb. 5, 2011, the entire contents of which are incorporated herein by reference.

BACKGROUND OF THE INVENTION

1. Field of Invention

The present invention relates to the field of handbags, tote bags and other fashion apparel bags, and more particularly to reversible bags having multiple exterior covers.

2. Description of Prior Art

There are a variety of tote bags on the market adapted for a variety of purposes and with features aimed to serve unique needs. In the realm of tote bags, consumers desire a product that provides the user with a fashionable bag that can be used in a variety of settings and well a matching with a variety of outerwear. Users typically will have multiple bags with various exterior colors and patterns which can be utilized in different circumstances and settings in accordance with a variety of factors such as the intended use, the intended setting or event.

Several bags exist on the market that provides an interchangeable exterior surface or cover. Examples of such handbags include those shown in US. Design Pat. D610,801 and U.S. Utility Pat. No. 7,607,461. However, both of the handbags that are disclosed in accordance with the above cited patents require that a user have a base handbag unit to which various exterior covers or surfaces may be applied. This requires that the user purchase multiple and individual components in order to take advantage of the variable exterior feature. Moreover, the user can only change the exterior surface when the user has access to multiple individual exterior covers.

While the above referenced patents demonstrate that combined bag and blankets are beneficial, it is also desirable at times to have a tote bag and blanket that will serve multiple purposes. At times it is desirable to have a tote bag with multiple functions, which preferably may include, but are not limited to pillow functions, beverage cooler functions, reversible bags, and pocket(s) on both the interior and/or exterior of the bag so that pockets are available even when the bag is in a reversed blanket mode. Although numerous improvements have been made in the bag industry, none effectively solve the problems addressed by the present invention.

SUMMARY OF THE INVENTION

It is accordingly the objective of the present application to disclose an embodiment of a multi-purpose tote bag that is readily reversible with multiple exterior colors and patterns that can be revealed by turning the tote bag inside out to reveal one of a plurality of exterior surfaces as selected by the user.

It is a further object of the present application to provide a multipurpose reversible tote bag that is assembled in a novel manner so as to provide a plurality of exterior surfaces available to the user and selectable by reversing the tote bag in a particular predetermined manner.

It is a further object of the present application to provide a multipurpose reversible tote bag featuring at least one pocket on the interior and/or the exterior surfaces of the product.

The present invention therefore provides a tote bag comprising: a selectively openable and closable bag opening; a plurality of compartments, each having an interior storage area; a first exterior bag surface and a second exterior bag surface; wherein said first or said second exterior surface of each of said plurality of compartments may be selectively displayed by turning said tote bag inside out; means for selectively opening and closing said tote bag opening; and, at least one means for toting said tote bag, wherein said plurality of compartments are attached to each other along a single line such that each compartment may move independently.

Other objectives of the application will become apparent to those skilled in the art once the invention has been shown and described. These objectives are not to be construed as limitations of the invention, but as embodiments that will be appreciated by those skilled in the art.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Although specific embodiments of the invention will now be described, it should be understood that these embodiments are examples only and merely illustrate a small number of the many possible specific embodiments that can represent application of the principles of the invention. Various changes and modifications obvious to one skilled in the art, to which the present invention pertains, are deemed to be within the spirit, scope and contemplation of the present invention as further defined in the claims.

Figure 1:
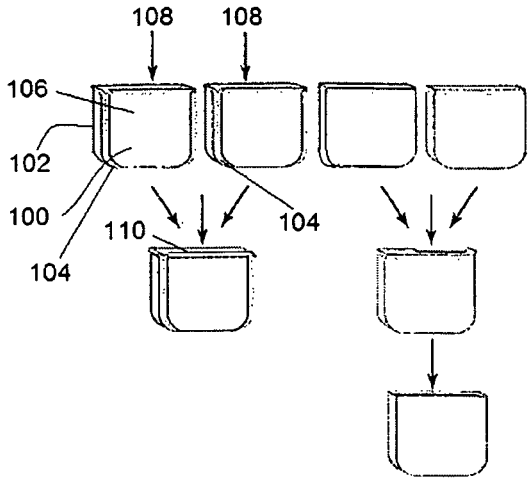
FIG. 1 is a side perspective exploded view of the multi-purpose reversible tote bag (hereinafter "tote bag") according to the present invention.
Figure 2:
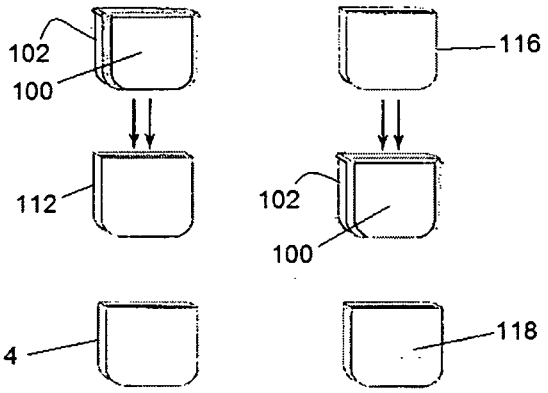
FIG. 2 is a side perspective exploded view of the multi-purpose reversible tote bag (hereinafter "tote bag") according to the present invention.
Figure 6:
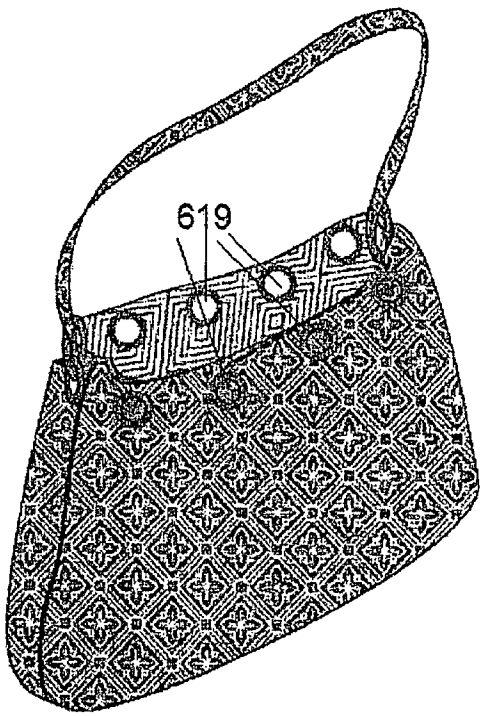
FIG. 6 is a perspective view of the multi-purpose reversible tote-bag in use depicting an additional feature of the invention.
Figure 6:
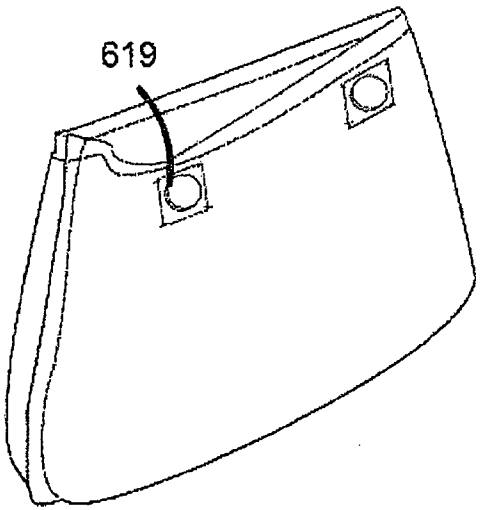

FIG. 1 is a side perspective exploded view of the multi-purpose reversible tote bag. FIG. 1 depicts variations of the tote bag according to the present invention. New FIG. 6 is a side perspective view of the multi-purpose reversible tote bag of. FIG. 1. FIG. 1 depicts variations of the tote bag according to the present invention. The embodiment shown includes a two compartment version 100 and 102. Each compartment is comprised of a continuous side wall 104, a front wall 106 and a back wall (not shown in this view) and an open top side 108. The compartments are only joined together along a top seam 110 between the two compartments and adjacent to the open top side 108. The seam 110 allows both compartments 100 and 102 to move independently of each other and as will be shown and described hereinafter may be reversed by turning one of the compartments inside of the other compartment. In this way either side of each compartment may be exposed as the exterior surface and the other compartment be turned inside of the other compartment. Additionally, as shown in FIG. 6, there may be a closure mechanism provided along the seam, such as for example a zipper, drawstring, concealed magnetic snaps,619 mechanically affixing snaps, buckles, buttons, clasps or clips, although this list is not meant to be limiting as to the means of closure. The zipper or other closure mechanism may be oriented in such a way such that the corresponding portions of the closure mechanism are in alignment. In this way, the closure mechanism may be utilized regardless of which exterior surface is exposed by the user. Additionally, each compartment may include a pocket on both the interior and exterior surface which may be used to accommodate a first compartment which is reversed within a second compartment. Alternately, a first compartment that is reversed within a second compartment may serve as an internal liner for the second compartment. FIG.2 further depicts this arrangement wherein there is shown compartments 100 and 102 in a first view. In the second view the tote bag is shown as a single compartment 112 where a first compartment, for example, 100 has be reversed and folded inside of a second compartment, for example 102, along seam 110. In this way, only the exterior surface of one compartment 112 is visible. That compartment 112 may also be reversed to switch the exposed surface, in other words, switch the inside with the outside 114. In this arrangement the first compartment is still contained and concealed within the second compartment, however, the exposed surface of the second compartment has been switched to reveal a different surface. Likewise as depicted in FIG. 2, the single compartment 116 may have the second compartment unfolded from within the first compartment to once again reveal both compartments 100 and 102. The user can then switch the order that the compartments are reversed, for example 102 has been reversed and folded inside of a second compartment 100, thereby leaving a single compartment 118 for the user. In this way, a user can with a single tote bag according to the present invention have in the embodiment depicted four possible exterior surfaces to display.

Figure 3:
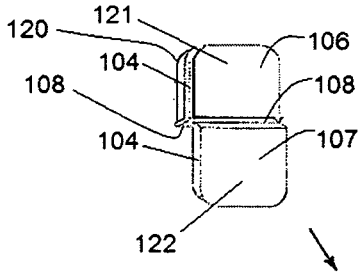
FIG. 3 is a side perspective exploded view of the multi-purpose reversible tote bag (hereinafter "tote bag") according to the present invention.
Figure 4:
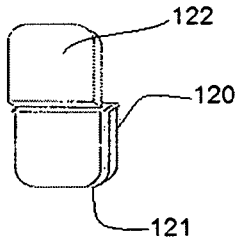
FIG. 4 is a side perspective exploded view of the multi-purpose reversible tote bag (hereinafter "tote bag") according to the present invention.
Figure 5:
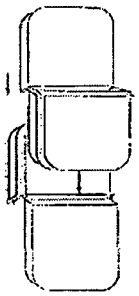
FIG. 5 is a side perspective exploded view of the multi-purpose reversible tote bag (hereinafter "tote bag") according to the present invention.

Turning now to FIG. 3, there is shown an embodiment of the present invention which includes three separate compartments, 120, 121 and 122. As described with respect to FIGS. 1 and 2, each compartment is comprised of a continuous side wall 104, a front wall 106 and a back wall 107 which is seen in this view as compartment 122 is shown as being rotated about seam 110 into an opposed orientation compartments and an open top side 108. The compartments are only joined together along a top seam 110 between the two compartments and adjacent to the open top side 108. The seam 110 allows both compartments 100 and 102 to move independently of each other. This is clearly depicted in FIGS. 4 and 5 with respect to the varying orientation of compartments 120, 121 and 122. As previously explained with respect to FIGS. 1 and 2, the single compartment 120 may have the second and third compartment folded within the first compartment and then unfolded from within the first compartment to once again reveal all compartments 120, 121 and 122. The user can then switch the order that the compartments are reversed, for example 121 and 122 have been reversed and folded inside of compartment 120, thereby leaving a single compartment for the user. In this way, a user can with a single tote bag according to the present invention have in the embodiment depicted six possible exterior surfaces to display.

As depicted in this view any number of compartments may be attached together in accordance with the teachings of this invention. While the examples depicted show the present invention as having two or three separate compartments, one skilled in the art will recognize that any number of compartments can be attached in accordance with the techniques disclosed herein.

Turning now to FIG. 6 there is shown an additional embodiment of the multipurpose reversible tote-bag according to the present invention depicting an additional feature which may be incorporated. FIG. 6 depicts the tote bag 600, which may include a strap 602. The strap may be attached to the tote-bag utilizing any means typically used in the art (not shown). For example, it may be attached using buckles, snaps, buttons, clasps, concealed magnetic snaps or clips, although this list is not meant to be limiting as to the means of attachment. The means of attachment are located on the top of the multipurpose reversible tote-bag such that they are accessible regardless of which exterior surface is exposed. Additionally, there may be included more than one set of attachment means such that the strap may be securely and removably attached to the tote-bag regardless of which exterior surface is exposed.

The strap provided may also be coordinated in appearance with the tote-bag by changing features such as color, style, texture, material and dimensions to match the tote-bag. Additionally, the strap may be reversible to expose either side of the strap thereby providing more options available to coordinate with the exposed tote-bag exterior.

Figure 7:
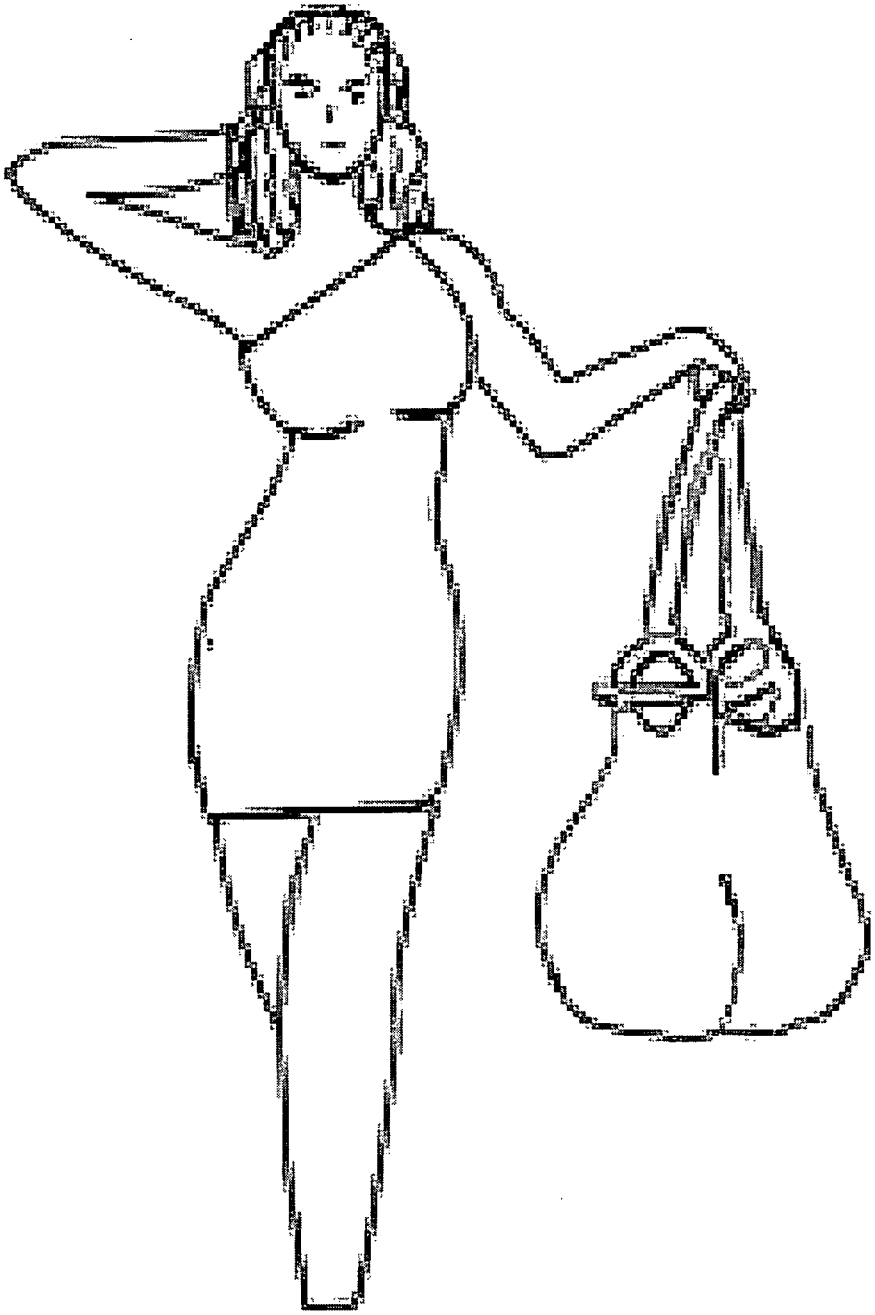
FIG. 7 is a perspective view of the multi-purpose reversible tote-bag in use depicting an additional feature of the invention.

Turning now to FIG. 7, an additional feature of the strap and multipurpose tote-bag according to the current invention is depicted. As set forth above, the strap 602 is removably affixed to the tote-bag 600 by the use of a releasable attachment means. The user may thus remove the strap 602 and thereupon use the strap as a fashion accessory option such as a belt as depicted in FIG. 7. The strap may be equipped with various devices in the manner typically known in the art to allow it to be securely worn as a belt. For example, the strap 602 may have a buckle or a hook and loop fastener or buttons, concealed magnetic snaps or mechanically affixing snaps which enable it to be securely worn by the user.

The preferable construction of tote bag is cloth, with a variety of cloth products known in the apparel industry to be preferable, including but not limited to cotton, cotton-poly blends, polyester, nylon, canvas, natural or synthetic woven textiles, polytetrafluoroethylene and perfluorocarbon resin products as sold under the Gore Tex® labels. Other desirable construction materials include but are not limited to denim, corduroy, washable suede, leather, suede, fur, and faux fur.

While certain novel features of this invention have been shown and described, it is not intended to be limited to the details above, since it will be understood that various omissions, modifications, substitutions and changes in the forms and details of the device illustrated and in its operation can be made by those skilled in the art without departing in any way from the spirit of the invention.

What is claimed:

1. A tote bag comprising: a selectively openable and closable bag opening; a plurality of Separate compartments, wherein each of said plurality of separate compartments has an interior and an exterior shell, wherein said interior shell is contained within said exterior shell and wherein each of said interior and exterior shell has a front wall and a rear wall connected by a sidewall and a bottom there between, and an open top side, wherein each of said interior and exterior shells are only joined together along a single top seam between said interior and exterior shell and wherein each of said plurality of compartments are joined to at least one other of said plurality of compartments by a first and second connection seam between each of said plurality of compartments said first and second connection scam being along a single seam line adjacent to said open top side, wherein said first connection seam and said second connection seam are located on opposite sides of said open top side of each of said plurality of compartments, each compartment having an interior storage area; a first exterior bag surface and a second exterior bag surface;

wherein said first or said second exterior bag surface of each of said plurality of compartments may be selectively displayed by turning any one of said compartments inside out and where each of said plurality of compartments may be turned inside out and selectively and independently folded within any one of said other plurality of compartments, to form an interior storage volume while turned inside out, a releasable closure mechanism for selectively opening and closing said tote bag opening; and, at least one handle for carrying said tote bag, wherein said plurality of separate compartments are fixedly attached to each other along said single top seam such that each compartment moves independently along said single top seam while attached to each other.

2. The tote bag of claim 1 wherein each of said plurality of compartments includes a pocket adapted on both said first exterior bag surface and said second exterior bag surface for receiving one of said-plurality of compartments.

3. The tote bag of claim 1 wherein said first exterior bag surface and said second exterior bag surface for each of said plurality of compartments have an different appearance.

4. The tote bag of claim 1 wherein said first exterior bag surface and said second exterior bag surface for each of said plurality of compartments are finished with a different material.

5. The tote bag of claim 1 wherein said first exterior bag surface and said second exterior bag surface for each of said plurality of compartments have an different texture.

6. The tote bag of claim 1 wherein said handle for carrying said tote bag is a strap.

7. The tote bag of claim 1 wherein said handle for carrying said tote bag is a drawstring.

8. The tote bag of claim 1 wherein said plurality Of compartments includes two compartments.

9. The tote bag of claim 1 wherein said plurality of compartments includes three compartments.

10. A tote bag comprising: a plurality of separate compartment sets, each comprised of at least two separate compartments, wherein a first of said at least two separate compartments is an inner compartment and wherein a second of said at least two compartments is an outer compartment and wherein each of said at least two separate compartments has an open top side, and a front wall and a rear wall connected by a sidewall and a bottom there between, each of said compartment sets having an interior storage area; a first exterior bag surface and a second exterior bag surface; and wherein said first or said second exterior bag surface of each of said plurality of said compartment sets may be selectively displayed by turning any one of said compartment sets inside out; wherein said inner and said outer compartment are only connected along a single top seam adjacent to said open top side and said compartment sets are fixedly attached to each other at a first and a second connection scam located along said single top seam and wherein said first and said second connection seam is located on an opposite side of said open top side of each of said plurality of separate compartment sets, such that any one of said compartments or compartment sets may be independently turned inside out across said single top seam line while attached to each other, and when any one of said compartment sets are turned inside out said compartment set is folded within any other of said compartment sets to form an interior storage volume having an access opening.

11. A tote bag as set forth in claim 10 wherein a plurality of compartment sets includes four compartment sets.

* * * * *